United States Patent [19]

Fitte

[11] 4,356,939

[45] Nov. 2, 1982

[54] DISTRIBUTING OR POURING CAPS, PARTICULARLY FOR BOTTLES OR OTHER CONTAINERS

[75] Inventor: Daniel Fitte, Paris, France

[73] Assignee: Rical S.A., Longvic, France

[21] Appl. No.: 119,966

[22] Filed: Feb. 8, 1980

Related U.S. Application Data

[63] Continuation-in-part of Ser. No. 887,370, Mar. 16, 1978, abandoned.

[30] Foreign Application Priority Data

Feb. 18, 1977 [FR] France ..... 77 04861

[51] Int. Cl.[3] ..... B65D 25/48; B65D 47/10

[52] U.S. Cl. ..... 222/541; 222/570

[58] Field of Search ..... 222/541, 567, 569, 570

[56] References Cited

U.S. PATENT DOCUMENTS

| | | | |
|---|---|---|---|
| 1,477,139 | 12/1923 | Lucas et al. | 215/321 |
| 2,763,403 | 9/1956 | Livingstone | 222/570 X |
| 3,239,113 | 3/1966 | Knize | 222/569 |
| 3,459,315 | 8/1969 | Labarre | 222/541 |
| 3,608,771 | 9/1971 | Monroe | 222/541 X |
| 3,610,484 | 10/1971 | Matzka | 222/541 X |
| 3,811,606 | 5/1974 | Higgins | 222/570 |

FOREIGN PATENT DOCUMENTS

| | | | |
|---|---|---|---|
| 1475639 | 2/1967 | France . | |
| 2380956 | 10/1978 | France | 222/541 |

*Primary Examiner*—F. J. Bartuska

*Attorney, Agent, or Firm*—Stevens, Davis, Miller & Mosher

[57] ABSTRACT

An improved pouring cap having a peripheral bellows above a horizontal annular portion, said bellows joining outside and inside skirt portions. This cap facilitates fitting upon bottle necks having substantial differences in neck thicknesses, and is particularly applicable to pouring caps having an easily removable sealing membrane therein, which membrane is removed prior to pouring contents from a bottle.

2 Claims, 1 Drawing Figure

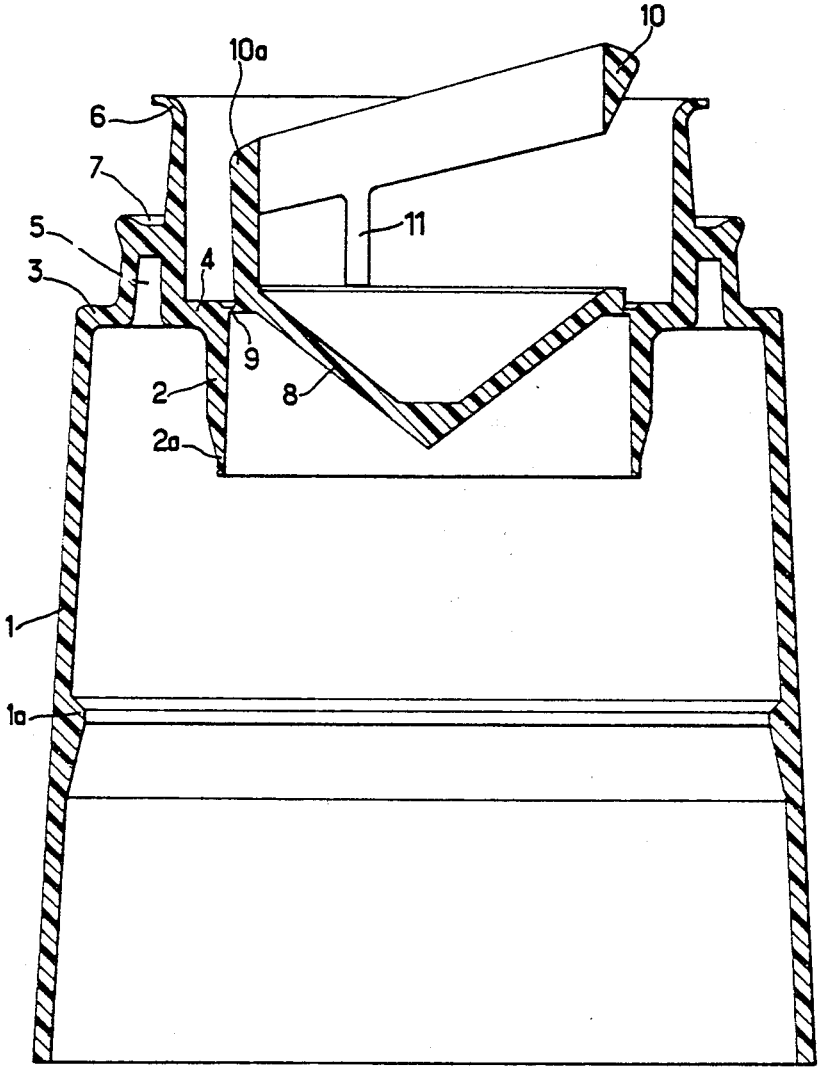
10
10a
6
7
5
3
4
11
9
2
8
2a
1
1a

DISTRIBUTING OR POURING CAPS, PARTICULARLY FOR BOTTLES OR OTHER CONTAINERS

This application is a continuation-in-part of Ser. No. 887,370, filed Mar. 16, 1978 now abandoned.

This application relates to molded, plastic distributing or pouring caps of the type suitable in particular for the necks of bottles or similar containers made of any kind of material. Such caps comprising a pouring rim or beak, separated from the inside of the bottle or container prior to utilization of said pouring cap by a hermetic membrane molded together with said cap and subsequently torn off using an inside gripping means such as a unitary ring solidly connected to at least one peripheral part of said hermetic membrane, are well known.

The object of the present invention comprises improvements in this type of pouring cap, one of which comprises in particular in replacing the vertical strip, ordinarily provided between the peripheral rim of the hermetic membrane and an inside sealing skirt for functioning inside the neck of said bottle or container, by a horizontal and annular connecting strip in order to avoid all leaks such as may be due to excessive excentricity of the hermetic membrane and its gripping ring with respect to the inside sealing skirts, resulting in insufficient thickness or practically none on one side of said hermetic membrane, the horizontal annular strip maintaining a radial thickness different from null around said membrane even when there is excentricity, such thickness furthermore being small enough to permit tearing it off.

Another object of the invention provides a hollow, forming a bellows, above that peripheral part of the pouring cap which functions with the upper part of the neck of said bottle or container, so as to allow easier fitting of said pouring cap into the neck of the bottle or container, despite the ordinarily large admissible tolerances relating to bottle necks and the like when being fabricated, the two inner and outer skirts of this pouring cap are capable of spreading apart with respect to each other due to the elasticity of the caps of this type, so that they may respectively apply against the inside and outside parts of these necks with the desired hermeticity and adjusting to the variable thickness of such necks, said bellows permitting a nipping of the neck of the bottle.

The feature of the present invention will be understood more clearly in relation to the description below of the embodiment of one improved pouring cap of the invention which is provided illustratively and without thereby implying restriction, referring to the single drawing attached hereto, which shows a diametrical cross-section of inner and outer skirts of said pouring cap, the pouring rim proper, and the gripping ring which permits tearing off said membrane.

This single FIGURE shows that said pouring cap comprises an outer skirt 1 comprising an inside boss 1*a* which is an annular thickening of the wall of said outer skirt 1 and which is meant to function with a groove of suitable profile made in the outside part of the neck of said bottle or container for snap-fastening the cap onto a bottle.

Said pouring cap also comprises an inner sealing skirt 2 which ends at its lower part in the form of a bevel 2*a*, facilitating the introduction of this inner skirt 2 into the neck of a bottle or similar container.

Radially extending parts 3 and 4, respectively connected to skirts 1 and 2 and for the purpose of resting against the upper collar of a bottle neck are separated by an annular expandable bellows 5 which is disposed in prolongation of the inner arm of said bellows, permits easier fitting of said pouring cap into bottles with varying wall thicknesses in the region of their necks, or into bottles which are of non-uniform neck thickness due to excentricity between the bottle neck's inside bore and its outside contour.

The pouring rim 6, which is disposed in prolongation of the inner arm of said bellows, may comprise a pouring beak at some point of its circumference and is provided with a profile, such that when the liquid from said bottle or container is poured, the drops forming the moment the bottle or container no longer is inclined will fall back into said bottle or container.

The sealing membrane 8 may be torn off at the level of the horizontal annular strip 9 surrounding it, by pulling on a gripping ring 10 shown in the drawing, said membrane 8 having the shape of a cone with its head turned towards the inside of the bottle. This shape of the membrane maintains liquid on the lower surface of the membrane and avoids the to avoid throwing out of liquid when the membrane is torn out.

In the embodiment shown in the single FIGURE of this drawing, ring 10 is of one piece or solidly connected with the peripheral part of membrane 8 by a single tongue 10*a*, but obviously said tongue may be replaced by two which are apart and solidly connected with the ends of a broken ring with a profile similar to that of the complete ring 10 shown in the figure.

Gripping of the ring, and hence tearing off the sealing membrane, is improved by including two small vertical tongues 11 located on either side of said tongue 10*a*, one of said small tongues being shown in said drawing.

These tongues keep the gripping ring 10 in the inclined position shown in said figure.

It is understood that any excentricity of membrane 8 and of ring 10 with respect to the lower parts of the pouring rim 6 is not introduced, as may be the case when a vertical strip is provided between membrane 8 and inside part 4 that may be of zero thickness over part of its circumference, whereby the required sealing could not be retained prior to tearing off said membrane.

Rather, in the case of the horizontal annular strip 9 shown in the figure of the application, said strip may vary in radial width at different points, and this width of the strip can be made larger than zero everywhere along its circumference, whereby the tearing carried out by the gripping ring 10 will be proper along the entire circumference of said membrane 8, regardless of the radial thickness of this annular strip of uniform and slight thickness, said tearing taking place at any point of the circumference thereof.

It is furthermore understood that various modifications may be introduced into the embodiment described above, furthermore various improvements or additions, and that certain components may be replaced by equivalent ones without thereby affecting the overall structure of the invention.

I claim:

1. A unitary cap for facilitating the pouring of contents from a bottle comprising:

an outer skirt having an inner annular boss for snap-fastening said cap onto a bottle, an inner skirt for fitting within the neck of a bottle, an annular portion connecting the upper end of said inner and outer skirts for resting against the upper surface of a bottle neck, an annular pouring rim extending axially from said annular portion, a removable sealing membrane joined to said annular portion by an annular strip surrounding said sealing membrane, said sealing membrane being shaped as a cone extending from the edge of the membrane and having its head turned in a direction towards the inside of a bottle when said cap is fastened thereon, and, a gripping ring for removing said sealing membrane and disposed above said membrane and connected at one end thereof to a peripheral part of said membrane by at least a first vertical tongue, said gripping ring being provided with two supplementary vertical tongues located on either side of said first vertical tongue closer to said one end of said gripping ring than to an opposite end of said gripping ring and abutting on a peripheral part of said membrane, said two supplementary vertical tongues permitting said gripping ring to be maintained inclined relative to said first vertical tongue, with the higher end of said inclined gripping ring being opposite to said one end, whereby the combination of the inclined gripping ring and the cone shaped sealing membrane facilitates the gripping of said gripping ring for removal of said sealing membrane.

2. A unitary cap for facilitating the pouring of contents from a bottle comprising:

an outer skirt having an inner annular boss for snap-fastening said cap onto a bottle and provided with an annular portion extending radially for resting against the upper surface of a bottle neck, an inner skirt for fitting within the neck of a bottle and provided with an annular portion extending radially for resting against the upper surface of a bottle neck, an annular expansible bellows having a U-shaped section and connecting said annular portions for permitting elastic expansion or contraction between said inner and outer skirts, an annular pouring rim disposed in prolongation of a portion of said bellows, a removable sealing membrane joined to said inner skirt by an annular strip surrounding said membrane, said sealing membrane being shaped as a cone extending from the edge of the membrane and having its head turned in a direction towards the inside of a bottle when said cap is fastened thereon, and, a gripping ring for removing said sealing membrane and disposed above said membrane and connected at one end thereof to a peripheral part of said membrane by at least a first vertical tongue, said gripping ring being provided with two supplementary vertical tongues located on either side of said first vertical tongue closer to said one end of said gripping ring than to an opposite end of said gripping ring and abutting on a peripheral part of said membrane, said two supplementary vertical tongues permitting said gripping ring to be maintained inclined relative to said first vertical tongue, with the higher end of said inclined gripping ring being opposite to said one end, whereby the combination of the inclined gripping ring and the cone shaped sealing membrane facilitates the gripping of said gripping ring for removal of said sealing membrane.

* * * * *